United States Patent [19]

Smith

[11] Patent Number: 5,025,995

[45] Date of Patent: Jun. 25, 1991

[54] APPARATUS AND CRUSHING DISPOSABLE CONTAINERS

[76] Inventor: Leo F. Smith, P.O. Box 1868, San Marcos, Calif. 92069

[21] Appl. No.: 516,563

[22] Filed: Apr. 30, 1990

Related U.S. Application Data

[63] Continuation-in-part of Ser. No. 383,720, Jul. 24, 1989, abandoned.

[51] Int. Cl.[5] ..... B02C 19/14

[52] U.S. Cl. ..... 241/101.1; 100/902; 241/99; 241/224; 241/235

[58] Field of Search ..... 100/902; 241/235, 236, 241/99, 101.1, 224, 225, 100, 222, DIG. 38

[56] References Cited

U.S. PATENT DOCUMENTS

| | | | |
|---|---|---|---|
| 1,648 | 3/1864 | Mumma | 241/222 X |
| 1,598,364 | 8/1926 | Cassell et al. . | |
| 2,978,999 | 4/1961 | Smith . | |
| 3,749,004 | 7/1973 | Pagdin et al. . | |
| 3,951,059 | 4/1976 | Morris . | |
| 4,862,796 | 9/1989 | Lodovico et al. . | |

FOREIGN PATENT DOCUMENTS

| | | | |
|---|---|---|---|
| 987953 | 4/1976 | Canada | 100/902 |
| 112842 | 1/1918 | United Kingdom | 100/902 |

*Primary Examiner*—Mark Rosenbaum

*Attorney, Agent, or Firm*—Henri J. A. Charmasson

[57] ABSTRACT

A compact apparatus for processing disposable containers at their collecting site uses a single pair of counter-rotating crushing rollers mounted one above the other. The containers are dropped against the upper surface of an indented feeding roller parallel and adjacent to the lower crushing roller. The cans are caught by a the peripheral indentations of the feeding rollers and horizontally kicked between the merging surfaces of the crushing rollers. An indented take-up roller on the opposite side of the lowest crushing roller catches the crushed containers and propels them obliquely upwards into a collecting bin.

14 Claims, 1 Drawing Sheet

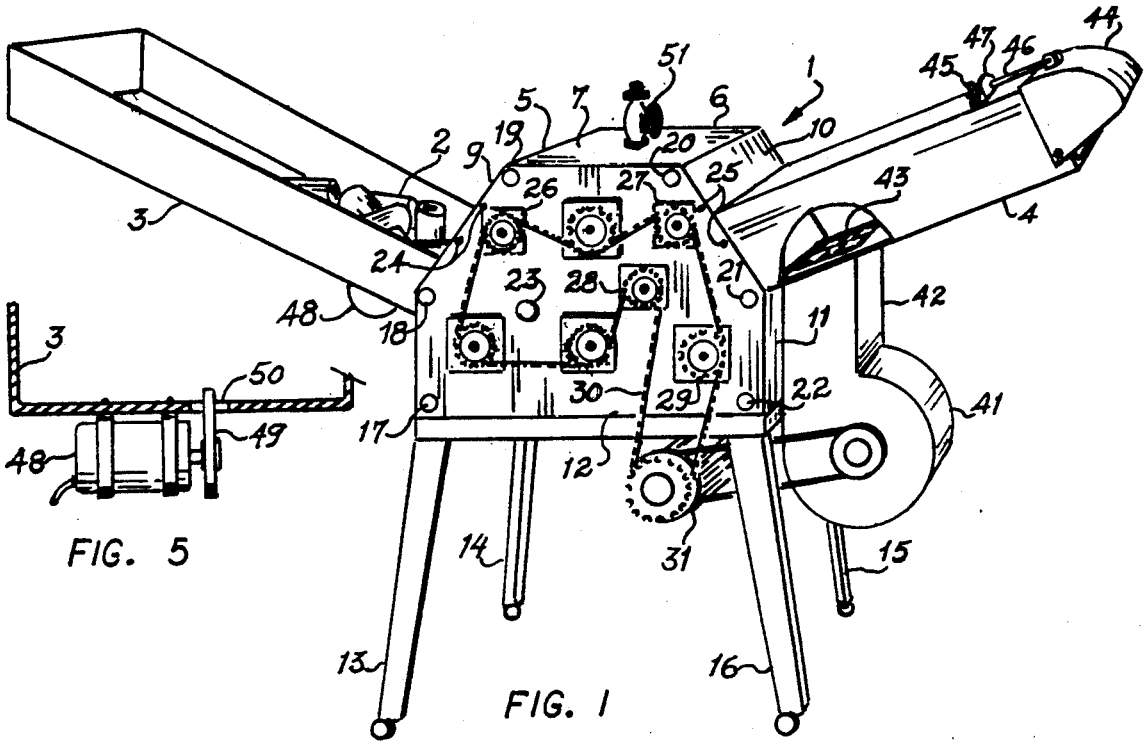
FIG. 1
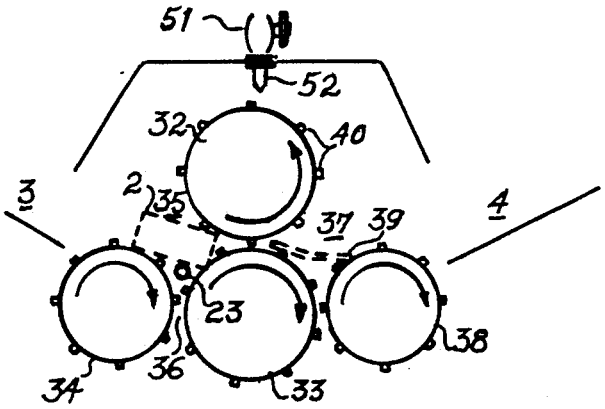
FIG. 2
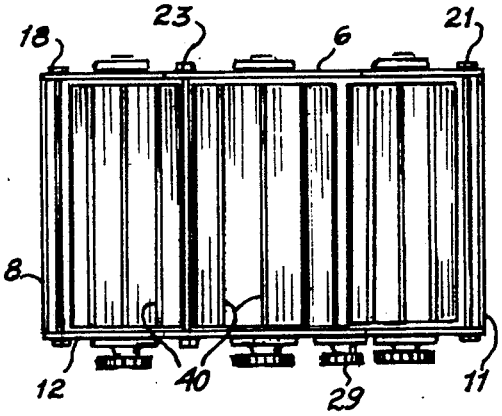
FIG. 3
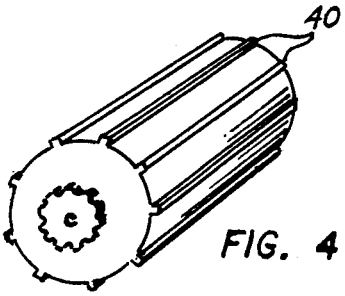
FIG. 4
FIG. 5

APPARATUS AND CRUSHING DISPOSABLE CONTAINERS

PRIOR APPLICATION

This application is a continuation-in-part of co-pending application Ser. No. 07/383,720 filed July 24, 1989, now abandoned.

BACKGROUND OF THE INVENTION

This invention relates to crushing and compacting devices, and more particularly to devices for crushing disposable metal cans.

Many jurisdictions have enacted regulations to encourage the recycling of disposable containers such as plastic bottles and metal cans. In those jurisdictions, the stores are sometimes compelled to collect both reusable and disposable containers to be reprocessed in an environmentally safe manner. Most beer and soft drink cans are now made of recyclable aluminum. Efficient handling of empty aluminum cans requires that they be crushed and compacted before storage and transportation to a melting plant.

There is, therefore, a need for a lightweight, compact, yet efficient can crushing device which could be used at the collecting site of recyclable beverage containers and safely operated by store managers.

Most apparatuses for crushing cans such as the one disclosed in U.S. Pat. No. 4,862,796 Lodovico et al. are of an industrial type with a size and capacity which limits their use at recycling centers and melting plants. Smaller crushing apparatuses such as the type disclosed in U.S. Pat. No. 3,749,004 Pagdin et al. retain an imposing size and considerable complexity. They are based on the same principle as the Lodovico design, that is, they rely on a succession of crushing or shredding roller pairs through which the cans are gravity-driven from a feeding hopper on top of the apparatus, down to a chute beneath the last set of rollers. This type of apparatus is prone to jamming when crushed material accumulates between two pairs of rollers. Accordingly, they must have complex anti-jamming mechanisms as well as means for separating the roller pairs so that the operators can remove the clogging material. This type of apparatus cannot efficiently be used on the premises of a retail store which usually does not have available the lifting equipment necessary to drop the cans in the hopper, nor the belt carrying or other loading equipment necessary to collect the crushed cans from underneath the apparatus and load them into crates or into the bed of a truck.

SUMMARY OF THE INVENTION

The instant invention addresses the above-described need for a compact, efficient, and lightweight can crusher which may be operated by untrained personnel at any site where disposable containers are returned by the consumer including on the premises of a retail store.

These needs are met by a simple crusher which uses only one set of counter-rotating crushing rollers through which the cans are forced by a single feeding roller. A single take-up roller on the exit side of the crushing pair not only accepts the crushed material rapidly to avoid any jamming, but ejects it upwardly toward a storage bin or even into the bed of a truck, without need for any type of conveyer belt or other loading device.

BRIEF DESCRIPTION OF THE DRAWING

FIG. 1 is a perspective view of the can crushing apparatus;

FIG. 2 is a diagrammatic representation of the rollers;

FIG. 3 is a top plan view of the roller assembly;

FIG. 4 is a perspective view of a roller; and

FIG. 5 is an illustration of the shaker assembly of the feeding hopper.

DESCRIPTION OF THE PREFERRED EMBODIMENT OF THE INVENTION

Referring now to the drawing, there is shown in FIG. 1 an apparatus 1 for crushing empty beverage cans 2 or the like. The apparatus could also be used for crushing glass and plastic bottles and other types of recyclable containers. The apparatus stands only approximately 1.2 meters high (four feet) and occupies only 0.6 square meters (6.25 square feet) of floor space exclusive of the feeding hopper 3 and discharge guide 4. The housing 5 of the crushing rollers assembly consists of a backplate 6, a roof plate 7, left side plates 8 and 9 not visible in FIG. 1, right side plates 10 and 11, and front plate 12. The side plates are welded to one another and to the backplate 6 to form a box open at the bottom and supported by caster-equipped legs 13–16. Side plate 9 has an opening and attachment for coupling to the feeding hopper 3. Plate 10 has an opening and attachment for coupling to the ejecting guide 4.

The front plate is removably secured by seven bolts 17–23 which pass through the entire assembly and connects to the backplate 6. Pairs of pins 24 and 25 extend from the sides of side plates 9 and 10 through bores in the front plate 12 to facilitate its alignment and mounting. The outer faces of the backplate 6 and front plate 12 mount corresponding sets of bearings for the rollers and for the auxiliary spur gears 26, 27, 28, and 29 which are used to route the driving chain 30. The crushing apparatus is driven by a single motor 31 mounted under the crushing roller assembly housing 5. This motor is preferably a standard 120 volt electrical motor. Although a small hydraulic drive motor could also be used.

The crushing mechanism is more specifically illustrated in FIGS. 2–4. The crushing of the cans 2 is accomplished by a single pair of counter-rotating rollers 32 and 33 having parallel axes lying in the same vertical median plane. Accordingly, the path of the cans 2 between the crushing rollers is along a horizontal direction from left to right. The cans 2 to be crushed fall freely from the feeding hopper against the top surface of a feeding roller 34 which rotates clockwise so as to direct the cans toward the take-up side 35 of the crushing rollers 32 and 33. The transversal bolt 23 lies horizontally between the feeding roller 34 and the lower crushing roller 33 on a 45 degree radius from the axle of the crushing roller 33. This bolt 23 prevents the can 2 from dropping too far into the interstice 36 between the feeding roller 34 and the crushing roller 33 where it could impact the crushing roller 33 at too shallow an angle, at the risk of being thrown back toward the hopper instead of being captured between the two crushing rollers. On the expelling side 37 of the crushing rollers, a take-up or ejecting roller 38 rotates in a clockwise direction to pull the crushed cans 39 away from the crushing rollers and eject them through the ejecting guide 4. The can-grasping ability of the various rollers is improved by a series of bars, cleats or dogs 40 welded in a direction parallel to the axes of the various rollers at regular intervals on the periphery of each roller. In some applications, the dogs 40 of the crushing rollers 32 and 33 may be replaced by teeth or other indentations designed to puncture or shred the cans. For maximum efficiency, the upper surface of the feeding roller 34 and of the ejecting roller 38 should be tangent to the horizontal plane passing between the two crushing rollers 32 and 33.

In the preferred embodiment the rollers are all made of steel. Their common length is 30 centimeters (12 inches), their weight falls within a range from 12 to 15 kilos (27 to 33 pounds) each. All the rollers, 32, 33, 34 and 38 are made from a section of steel tubing. In each roller, almost the entire weight, including the weight of the dogs, is substantially distributed along its periphery. The crushing rollers, thus, act as two flywheels where the size, speed and weight are critical in determining the amount of stored energy necessary to assure a fast and steady throughput. For maximum efficiency the diameters of the crushing rollers should be between two and eight times the average diameters of the containers to be crushed. Most aluminum beverage cans have a diameter of approximately 6 centimeters (2 ½ inches). The diameter of the crushing rollers should fall between 12 and 50 centimeters (5 to 20 inches). The optimum rotating speed of the crushing roller should be between 700 and 1,100 revolutions per minute. Maximum throughput was experienced with crushing rollers of 13.5 kilograms (30 pounds) with a diameter of 18 centimeters (7 inches) rotating at 800 revolutions per minute. Under those conditions each crushing roller stores approximately 415 joules (300 foot-pounds) of kinetic energy which may account for the impressive performance of the apparatus. Satisfactory operation can be achieved with crushing rollers of much lesser size and weight with a capacity of 140 joules (100 foot-pounds) running at the same speed. The distance between the peripheral surfaces of the crushing rollers should be lesser than the smallest dimension of the smallest container to be crushed. For crushing aluminum beverage cans, the gap between the peripheral surfaces of the crushing rollers equipped with inter-meshing dogs should be approximately 0.95 to 1.6 centimeter (⅜to ⅝ of an inch) with maximum performance at 1.27 centimeters (½ inch). For maximum efficiency the dogs 40 are spaced about 10 centimeters (4 inches) apart, and the height and width of each dog do not exceed 0.63 centimeter (¼ inch). For optimum performance, the feeding roller 34 should have a diameter about 15 percent smaller than the diameter of the crushing rollers and should rotate approximately 100 revolutions per minute slower than the crushing rollers. The ejector roller should also have a diameter 15 percent smaller than the diameter of the crushing roller, but should rotate at about 700 revolutions per minute faster than the crushing rollers.

Given the above-listed characteristics, the apparatus was observed to process 1,700 cans per minute when driven with a 1.5 horsepower motor. The crushed material 39 was projected a distance in excess of 12 meters (40 feet) absent the ejecting guide 4. The projected distance can be extended to 18 meters (60 feet) when the apparatus 1 was equipped with the ejecting guide 4 and a squirrel cage blower 41 driven by the electrical motor 31. A duct 42 leads the forced-air generated by the blower 41 to the base section of the ejecting guide 4 through a grid 43 that prevents crushed debris from falling into the blower assembly 41. An adjustable hood 44 is used to limit the trajectory of the crushed cans and force them to drop into a nearby bin or into the bed of a truck. The sides of the hood 44 are pivotally connected to the sides of the ejecting guide 4, and its position can be adjusted by means of a wing-nut 45 mounted on a threaded stem 46 passing through a bracket 47 welded to the roof of the guide 4. The feeding movement of the hopper 3 may be improved by mounting underneath, a motor which drives one or more beating paddles 49 asymmetrically mounted on the shaft of the motor 48. The beating paddles 49 passes through a slot 50 in the lower bottom area of the hopper 3. This mechanism improves the operation of the hopper in two ways. First the beating action of the paddles 49 against the stack of cans 2 prevents any jamming of the cans near the opening of the crushing mechanism box 5. Secondly, the imbalance of the paddles 49 causes the motor 48 to vibrate and to transmit those vibrations to the hopper itself, thus improving the downward movement of the cans 2.

A valve 51 mounted in the roof of the apparatus 7 controls an internal spraying nozzle 52. The valve can be connected to a water hose for cleaning the apparatus from any residual beverage which may spill from the crushed cans.

It should be noted that since all the bearings for the rollers and auxiliary gears are mounted on the outer faces of the front and backplates, the crushing mechanism can be easily dismantled by unlocking the bearings of the backplace 6 and dropping the front plate 12 after removing the seven bolts 17 through 22.

While the preferred embodiment of the invention has been disclosed, modifications can be made and other embodiments may be devised without departing from the spirit of the invention and the scope of the appended claims.

What is claimed is:

1. An apparatus for crushing disposable container which comprises:

a crushing mechanism and a feeding mechanism;

wherein said crushing mechanism consists of two counter-rotating rollers having parallel axes lying in the same vertical plane and peripheral surfaces separated by a distance lesser than the smallest dimension of the smallest of said containers; and wherein said feeding mechanism consists of a single non-crushing feeding roller horizontally adjacent and parallel tot eh lowest of said crushing rollers and rotating in the same direction as said lowest crushing roller, and means for free-dropping said containers against an upper surface area of said roller; wherein said feeding roller has a plurality of peripheral indentations;

said means for free-dropping comprises a hopper having an outlet immediately above and spaced apart from said upper area of the feeding roller; and which further comprises a single non-crushing ejecting roller horizontally adjacent and parallel to said lowest crushing roller, positioned on the opposite side of said lowest crushing roller from the feeding roller, and rotating in the same direction as said feeding roller.

2. The apparatus of claim 1, wherein said crushing rollers have a plurality of peripheral indentations.

3. The apparatus of claim 1, wherein the rotating speed of the feeding roller is slower, and the rotating speed of the ejecting roller is faster, than the rotating speed of the crushing rollers.

4. The apparatus of claim 3, wherein said ejecting roller has a rotating speed generally 60 percent to 100 percent faster than the rotating speed of the crushing rollers.

5. The apparatus of claim 4, wherein the feeding roller has a rotating speed generally 9 to 14 percent slower than the rotating speed of the crushing rollers.

6. An apparatus for processing disposable containers which comprises:

a first treating roller having a first horizontal axis of rotation, and an indented first peripheral surface;

a second treating roller having a second axis of rotation parallel to, and in a generally vertical plane with the first axis of rotation, an indented second peripheral surface, and a radius commensurate with the radius of the first treating roller;

the distance between said first and second peripheral surfaces being less than the smallest dimension of the containers;

means for rotating said rollers in opposite directions;

a single non-crushing feeding roller positioned alongside the take-up side of said treating rollers and having a third axis of rotation parallel to the first and second axes of rotation, and an indented third peripheral surface proximate to the second peripheral surface and tangent to a generally horizontal plane equidistant from the first and second peripheral surfaces;

means for rotating said feeding roller in the same direction as the second treating roller;

means for dropping containers against an upper area of said third peripheral surface; and a single non-crushing ejecting roller having an axis of rotation in a same general horizontal plane as the axis of rotation of the feeding roller, a fourth peripheral surface proximate to the expelling side of the treating rollers; and means for rotating said ejecting roller in the same direction as the second treating roller.

7. The apparatus of claim 6, wherein the feeding roller rotates at a lower speed than the treating rollers, and the ejecting roller rotates at a higher speed than the treating rollers.

8. The apparatus of claim 7, wherein said third and fourth peripheral surfaces comprise indentations.

9. The apparatus of claim 8, wherein said indentations comprise a plurality of bar-like dogs generally parallel to the axes of rotation.

10. The apparatus of claim 7, wherein said ejecting roller has a speed generally 60% to 100% faster than the speed of the treating rollers.

11. The apparatus of claim 12, wherein said feeding roller rotates at a speed generally 9% to 14% slower than the first and second treating rollers.

12. The apparatus of claim 11, wherein the treating rollers have a speed in a range from 700 to 1,100 rotations per minute, and are weighted and dimensioned to store together at least 280 joules of kinetic energy at said range of speed.

13. The apparatus of claim 12, wherein the diameter of the treating roller is generally within a range from two to eight times the smallest dimension of the containers.

14. The apparatus of claim 11, wherein said feeding and ejecting rollers have a diameter generally 15% smaller than the diameter of the treating rollers.

* * * * *